United States Patent [19]

Forbes

[11] Patent Number: 4,886,302

[45] Date of Patent: Dec. 12, 1989

[54] REPAIR FLANGE

[76] Inventor: Chritopher B. Forbes, 2900 Misty Plum Ct., Fort Mill, S.C.

[21] Appl. No.: 223,925

[22] Filed: Jul. 25, 1988

[51] Int. Cl.[4] ..... F16L 55/00

[52] U.S. Cl. ..... 285/56; 4/252 R

[58] Field of Search ..... 285/56, 57, 58, 59, 285/60; 4/252 R, 419

[56] References Cited

U.S. PATENT DOCUMENTS

| | | | |
|---|---|---|---|
| 712,022 | 10/1902 | Underhill | 285/56 |
| 879,176 | 2/1908 | Jackson | 4/252 R |
| 938,533 | 11/1909 | Wheeler | 285/58 |
| 1,533,444 | 4/1925 | Mohr | 285/58 X |
| 3,419,298 | 12/1968 | Worley | 4/419 X |
| 4,648,139 | 3/1987 | Stokes | 285/56 X |

*Primary Examiner*—Thomas F. Callaghan

[57] ABSTRACT

The repair flange comprises of but not restricted to two parts of thin rigid flat sheet material which are structured so that they can be flush mounted over finish floor material. The repair flange is provided with a circular opening on the parts whereby the parts form a complete circle surrounding the neck under the attachment rim of a closet flange. The circular opening fits closely around the neck of the closet flange and the body of the flange extends over the floor surface beyond the area covered by the base of rim of the closet flange. This provides for attachment or fastening through the base of the closet flange and to floor material situated outside the base of the closet flange. The repair flange ties in a larger area of floor material into the anchoring of the closet flange to the floor surface. The device is constructed from material thin enough to be installed under the base of existing connected closet flanges without the necessity of disconnecting the closet flange from the drain system yet it is rigid enough to provide a stronger connection between the closet flange and the floor system. The repair flange fits neatly within the confines of the base of the toilet bowl. The repair flange is primarily adapted to repair the floor material located directly under the base of toilet bowls which contributes to a snug and tight connection of the toilet bowl to the floor system.

8 Claims, 2 Drawing Sheets

REPAIR FLANGE

BACKGROUND AND SUMMARY OF THE INVENTION

The present invention relates to the attachment of toilet bowls to the floor system where the connection is made to the drainpipes. More particularly to a device designed to repair the floor surface material located under the base of toilet bowls, where they are connected through the finished flooring material. The present invention is primarily designed to, but not restricted to repairing loose toilet bowl conditions by providing a rigid base which extends beyond the floor surface that is covered by the attachment rim of closet flanges without the need to disconnect the closet flange or remove flooring material. The device is structured to be flush mounted over the finish floor surface and fit under the attachment rim of the closet attachment flange. Toilet bowls are generally connected to the drain system with the use of a closet flange. The flange is affixed to the soil pipe and secured to the flooring system with screws or bolts that extend through the closet flange into the floor material located directly beneath it. The toilet bowl is secured to the closet flange with bolts which extend from the closet flange through the base of the toilet bowl. A wax seal is generally used to seal the connection of the toilet bowl to the closet flange. This seal is primarily what prevents the connection from leaking at floor level. The toilet bowl must be tightly connected to the floor system in order for the wax seal to be effective. If the connection is not secure it will allow the toilet bowl to tilt or wobble, the seal can be damaged and lose its effectiveness. A tight connection can be accomplished only over sound floor material. A secure connection also requires an adequate amount of floor material to exist between the attachment screw from the closet flange and the opening in the floor material. Often the hole for the drain pipe is cut irregular in shape or too large. This condition will not provide enough floor material between the fastening screw and the opening for the drain pipe to make a solid connection. There are some situations where the floor material around the opening is deteriorated or the composition of the material does not provide a secure gripping surface around the immediate opening for the fastening screws. An unsound connection from the closet flange to the flooring material could allow the toilet bowl to wobble or shift enough to damage the toilet bowl seal, causing the toilet to leak around the base. The repair flange will provide a solid base for attaching the closet flange to the floor system. The function of the repair flange is primarily but not restricted to, repairing loose toilet bowl connections. The repair flange is designed to fit in close relationship thereto around the neck of the closet flange between the floor material and the under side of the closet flange. The repair flange extends beyond the perimeter of the attachment rim of the closet flange and covers a larger area of floor material. This enables fastening of the repair flange to the floor material outside the area covered by the closet flange. In the past it has been necessary to make structural repairs to the floor system in order to repair a loose connection of the toilet bowl to the floor system. This, of course, is a difficult task and of considerable expense. Loose connections are often improperly repaired or left unrepaired because of this. The repair flange adds support to the floor material surrounding the drain pipe. There is thus a need for a device that can be easily installed and will effectively eliminate or repair loose toilet bowl and closet flange connections to the floor system.

DESCRIPTION OF PRIOR ART

Numerous devices have been invented for use in the connection of toilet bowls to drain systems but none are for the purpose of repairing deteriorated or poorly fitted floor material existing around drain pipes. None of the prior art is designed to reinforce and repair the floor material supporting the closet flange and the toilet bowl. The arrangement disclosed in prior art devices cannot be installed over finished floor surfaces. Furthermore there does not exist a prior art device which can be inserted between the closet flange and the floor surface material and fastened without disconnecting the closet flange from the drain pipe and making structual modifications to the flooring material.

Examples of prior art references cited:

| | | | |
|---|---|---|---|
| 4,207,630 | 6/1980 | Bressler | 4/452/R |
| 3,479,060 | 11/1969 | Westbrook, Mickley | 285/58 |
| 4,109,327 | 8/1978 | Jones | 4/252R |
| 4,052,759 | 10/1977 | Hill | 4/252R |
| 4,515,398 | 5/1985 | Machon | 285/59 |
| 4,224,702 | 9/1980 | Bretone | 4/252R |
| 4,112,567 | 9/1978 | Bretone | 29/157R |
| 3,349,412 | 10/1967 | Schwartz | 4/252 |
| 3,419,288 | 12/1968 | Logsdon | 285/58 |
| 4,423,526 | 1/1984 | Izzi | 4/252R |
| 3,125,765 | 3/1964 | Fay | 4/252 |
| 4,530,629 | 7/1985 | Sakow | 4/252R |
| 4,470,162 | 9/1984 | Marshall | 4/252R |
| 3,990,135 | 11/1976 | De Angelis | 29/157R |
| 3,967,326 | 7/1976 | Tammen | 4/452R |
| 4,261,598 | 4/1981 | Cornwall | 285/56 |

BRIEF DESCRIPTION OF THE DRAWINGS

Other advantages of the invention will become apparent to those skilled in the art from the following detailed description of the invention in conjunction with the accompanying drawings in which;

FIG. 5 shows a typical condition where gaps could exist between the floor material and the fastening screw from the closet flange. FIG. 5 shows the repair flange supporting the closet flange bridging past the gap and fastened to the floor system outside the area covered by the closet flange.

DETAILED DESCRIPTION OF THE INVENTION

Figure 1:
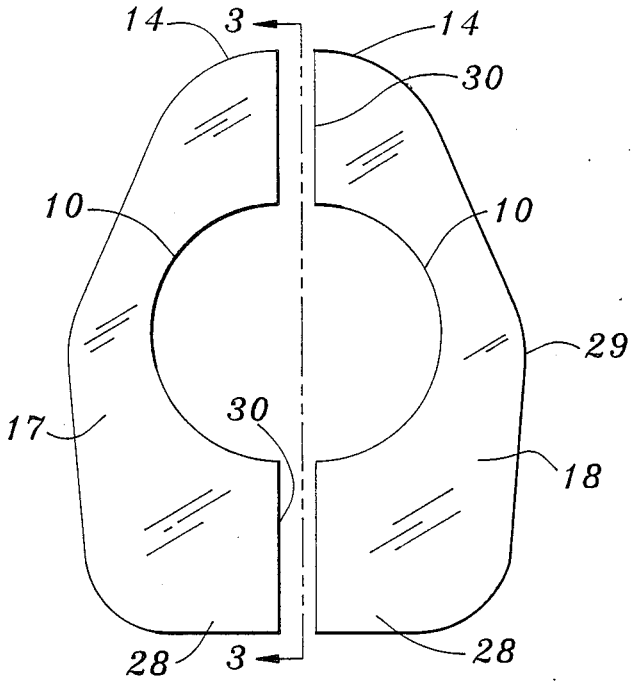
FIG. 1 is a perspective top view of the repair flange consisting of a left and right side in accordance with the preferred embodiment of the invention.
Figure 2:
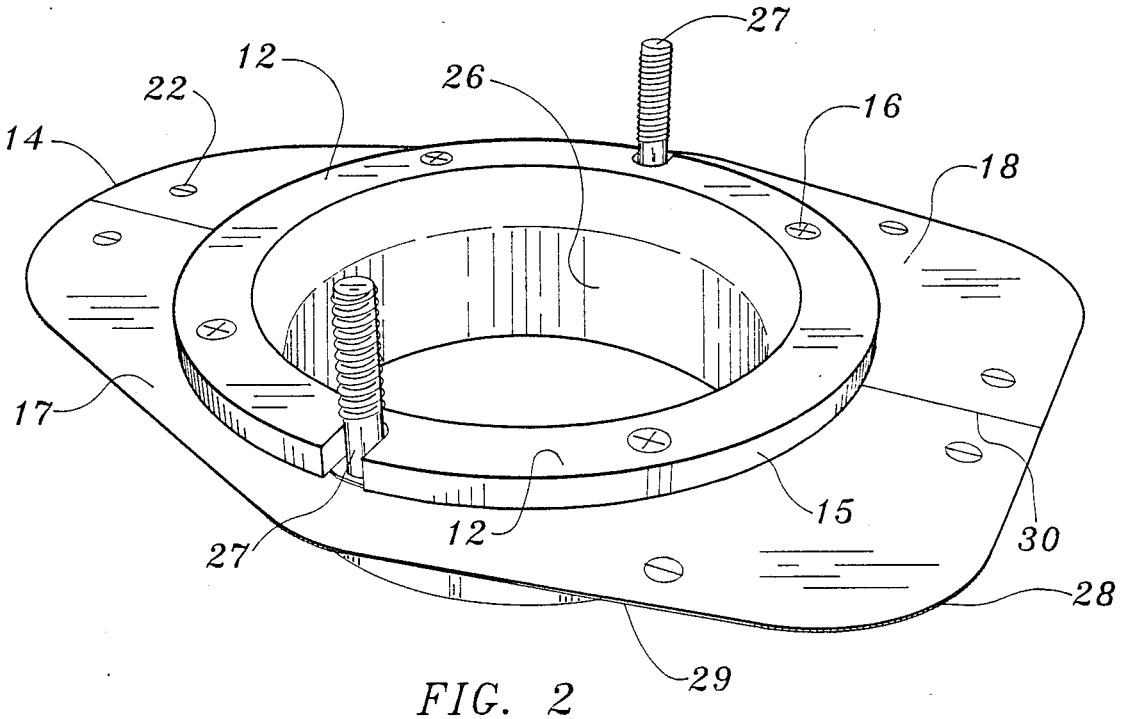
FIG. 2 is a perspective view of the repair flange mechanically fastened in place under a closet flange showing toilet bowl attachment bolts and attachment screws in place.
Figure 5:
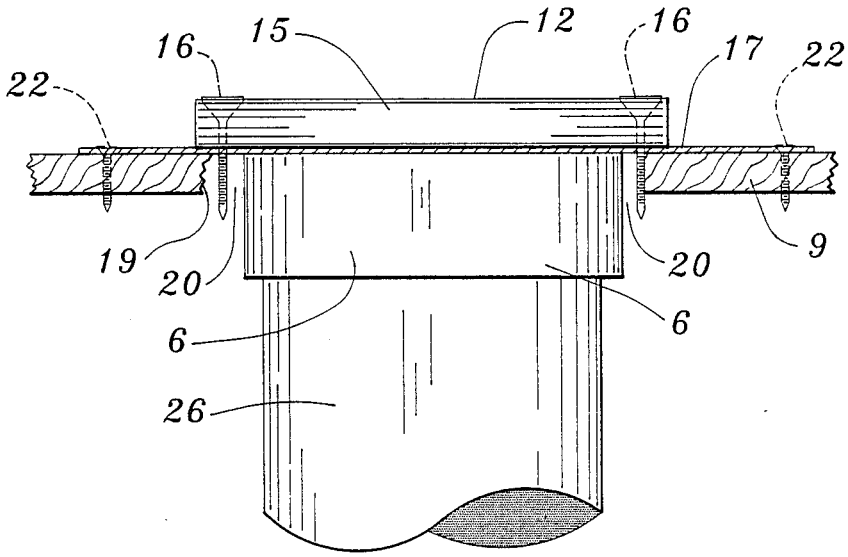
FIG. 5 is a cross-sectional view of the novel repair flange as seen along line 3 of FIG. 2 in place over a wood floor system.
Figure 6:
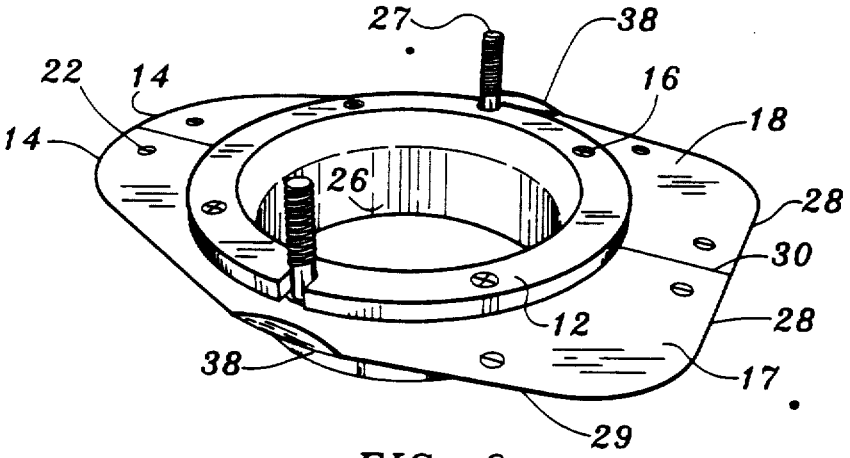
FIG. 6 is a perspective view of the repair flange in accordance with the present invention and showing tabs protruding past the attachment rim of the closet flange.
Figure 7:
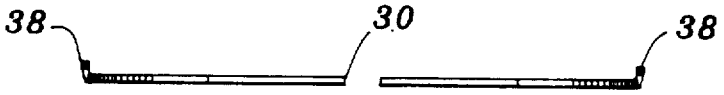
FIG. 7 is a cross-sectional view of the repair flange with tabs as seen from the front edge of FIG. 6.
Figure 8:
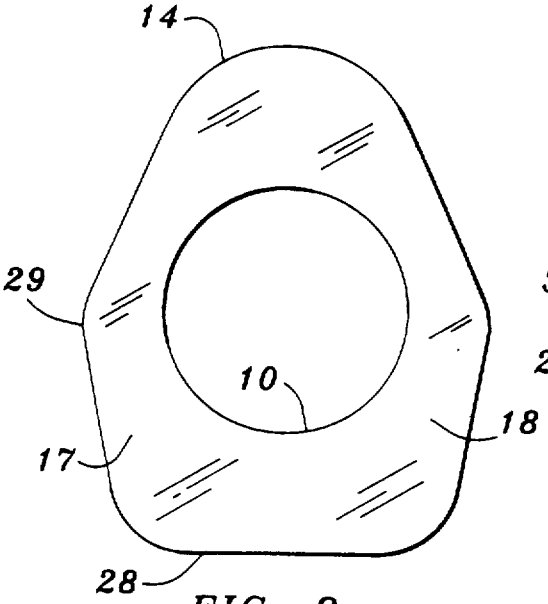
FIG. 8 is a plan view of the repair flange in accordance with a second embodiment of the present invention which is a one-part flange member.
Figure 9:
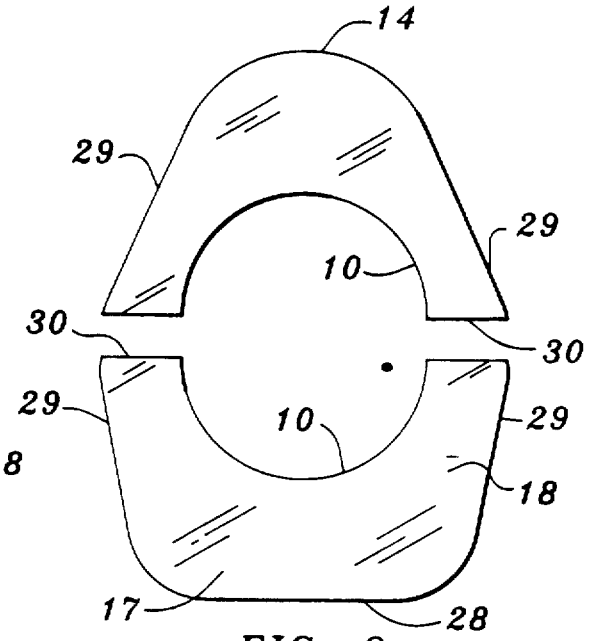
FIG. 9 is a plan view of the repair flange in accordance with a third embodiment of the present invention which consists of front and back flange members.

The present invention is directed to a flat device consisting of a left and a right side as shown in FIG. 1. The two sides left (17) and right (18) are designed to confront one another at the inner edge (30) to form a complete circle (10) to fit in close relationship thereto around the neck of the closet flange (6). The front edge (28) extends out beyond the area covered by the base of the closet flange (12) which enables it to be attached or fastened to the floor material (9) with conventional screws (22) outside the base of the closet flange and the opening (19) for the drain pipe (26) referring to FIG. 5. The circular edge, (10), being in close relationship thereto fitted around the neck of the closet flange provides a strong and rigid surface under the attachment rim of the closet flange (12). This allows for a secure connection with the screws (16) located in the attachment rim of the closet flange (12) even when a gap exists (20) between the floor material (9) and the attachment screws (16) located in the attachment rim of the closet flange. The repair flange provides an attachment surface in situations where the floor material (9) does not provide sound gripping for the attachment screws (16). FIG. 5 shows gap (20) existing between the closet flange and the edge of the floor material (9).

Figure 3:
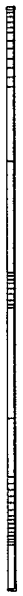
FIG. 3 is a cross-sectional view of the novel repair flange as seen along line 3 on FIG. 1 and line 3 on FIG. 2.

The device provides a rigid and sound surface when inserted between the closet flange and the floor material (9). The repair flange is fastened through the closet flange with conventional fastening screws (16) into the floor material (9) outside the floor surface covered by the closet flange. The device is made from thin flat sheet material referring to FIG. 3 and shown on the cross-sectional view of FIG. 5. This feature enables the device to be installed without disconnecting the closet flange from the drain pipe.

Figure 4:
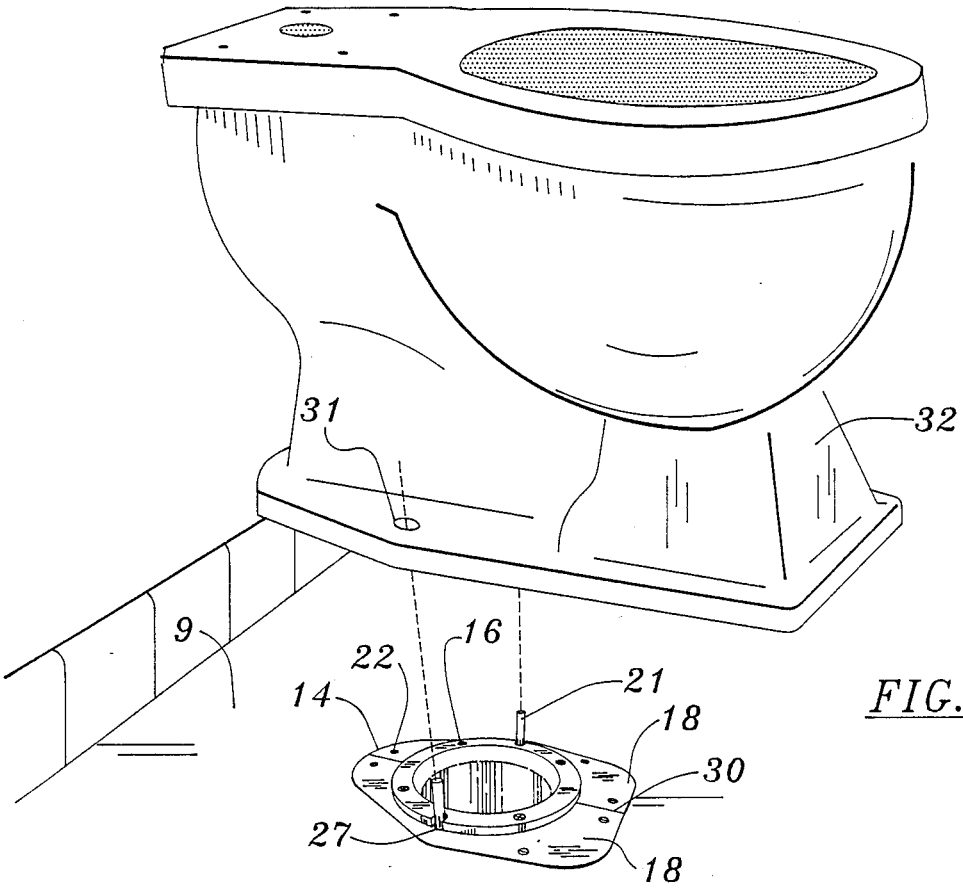
FIG. 4 is a perspective view of the repair flange consisting of a left side and right side in place under a closet flange in perspective location under a toilet bowl.

The repair flange is shaped so that it will be completely contained within the toilet bowl base (32) as illustrated in FIG. 4. The device provides a base for the toilet bowl attachment bolts (27) which are normally fastened through the opening in the base of the toilet bowl (31).

The preferred shape of the present invention consists of two parts of thin flat sheet material forming a left (17) and a right side (18). The front edge (28) which curves around to form the outside edge (29) which tapers out to near the center opposite the circular opening then tapers in toward the back edge of the flange (14) which turns approximately 90 degrees from the back edge to the inner edge (30) where the two parts confront one another forming a substantially straight line toward the front edge of device to a circular opening (10) which is cut out toward the outside edge of the device. The line of the inside edge continues from the opposite end of the circular opening (10) straight to the front edge where it turns approximately 90 degrees toward the outside edge (28) of the device. The device is shaped and sized to be able to be completely contained within the area of flooring that is covered by the base of a toilet bowl (32). This feature along with being constructed from thin flat sheet material allows the device to be installed over a finished floor surface. The device covers a substantially larger area of floor surface than the closet flange thus adding a strong and rigid support to the flooring system and the closet flange. The repair flange provides a sound and secure surface on which the closet flange can be tightly attached to the finished floor surface. When this is accomplished the toilet bowl can be connected tightly to the closet flange. This will eliminate the problem of closet bowl seals being damaged from shifting or wobbling toilet bowls. Other embodiments of the repair flange that are not shown on the accompanying drawings consist of front and back flange members or flange members that include tabs (38) protruding past the attachment rim of the closet flange.

The foregoing detailed description of the invention is provided primarily for the purpose of illustrating the preferred embodiment of the invention. It will be recognized by those skilled in the art that the preferred embodiment is not intended to be limited to the particular structures and methods of operation as they may be readily modified.

The repair flange can be manufactured in several sizes and shapes to accommodate various amounts of support over floor surfaces which can include two sections having front and back parts or a one-piece flange. Additionally, tabs #38 can protrude on the outside edges of the flange members.

It will be further readily apparent to those skilled in the art that numerous other modifications not mentioned herein can still be made without departing from the spirit and scope of the invention as claimed in the following claims.

What is claimed is:

1. In combination with the closet flange and floor surface supporting a toilet bowl base thereon such as commonly found in bathrooms, a repair flange anchored to the floor and secured to the underside of the attachment rim of the closet flange and being an integral part of the closet flange so as to extend the anchoring surface of the closet flange over a larger area of the finished floor surface that exists under the toilet bowl base and received over the gaps in deteriorated and poorly cut floor openings underneath the attachment rim of the closet flange, said repair flange comprising a substantially rigid and flat sheet material flange member of predetermined shape having outer, peripheral edge portions which include front, back, and side edges, said front, back, and side edges being dimensioned so that said flange member is contained within the base of the toilet bowl, said flange member also including inner edge portions defining a substantially circular opening located substantially medially between respective outer, peripheral edges, said inner edge portions surrounding in close relationship thereto the neck of a closet flange underneath the attachment rim of said closet flange, means engaging said flange member and underlying floor surface to secure said flange member to said underlying floor surface, and means engaging the attachment rim of said closet flange and flange member to secure the flange member to said closet flange.

2. The combination as claimed in claim 1 wherein said means engaging said flange member and the underlying floor surface include screws.

3. The combination as claimed in claim 1 wherein said means engaging said flange member and the closet flange include screws.

4. The repair flange as claimed in claim 1 wherein said side edges taper outwardly from said back edge.

5. The repair flange as claimed in claim 1 wherein said side edges taper outwardly from said front edge.

6. In combination with the closet flange and floor surface supporting a toilet bowl base thereon such as commonly found in bathrooms, a repair flange anchored to the floor, and secured to the underside of the attachment rim of the closet flange and being an integral part of the closet flange so as to extend the anchoring surface of the closet flange over a larger area of the finished floor surface that exists under the toilet bowl base and received over the gaps in deteriorated and poorly cut floor openings underneath the attaching rim of the closet flange, said repair flange comprising a substantially rigid and flat sheet material flange member of predetermined shape, said flange member having two separate flange member parts, each flange member part having outer, peripheral side edge portions and substantially straight inner edge portions, which each include in a medial portion thereof a curved portion defining a half circle, said straight inner edge portions of respective parts confronting each other to form said flange member, said flange member parts being dimensioned so that said flange member includes front, back and side edges contained within the base of the toilet bowl, and said inner curved portions of flange member parts surround in close relationship thereto the neck of the closet flange underneath the attachment rim of said closet flange, means engaging each of said flange member parts and said underlying floor surface to secure said flange member to said underlying floor surface, and means engaging the attachment rim of said closet flange and said flange member parts to secure the flange member parts to said closet flange.

7. The combination as claimed in claim 6 wherein said means engaging said flange member parts and the underlying floor surface include screws.

8. The combination as claimed in claim 6 wherein said means engaging said flange member and the closet flange include screws.

* * * * *

UNITED STATES PATENT AND TRADEMARK OFFICE

CERTIFICATE OF CORRECTION

PATENT NO. : 4,886,302

DATED : December 12, 1989

INVENTOR(S) : Christopher B. Forbes

It is certified that error appears in the above-identified patent and that said Letters Patent is hereby corrected as shown below:

The sheet of Drawing consisting of Figs. 6,7,8 and 9 should be added as shown on the attached sheet.

Signed and Sealed this

Twenty-ninth Day of September, 1992

*Attest:*

DOUGLAS B. COMER

*Attesting Officer*

*Acting Commissioner of Patents and Trademarks*